US006391156B1

(12) United States Patent
Hjalmarson et al.

(10) Patent No.: US 6,391,156 B1
(45) Date of Patent: May 21, 2002

(54) MANUFACTURE OF PAPER AND PAPERBOARD

(75) Inventors: Bo Hjalmarson, Gävle; Hans Åsberg, Hundiksvall; Per-Ola Eriksson, Domsjö ; Torbjörn Ljungqvist, RÅÅ, all of (SE); Gary Peter Richardson, Bradford (GB); Gordon Cheng I Chen, Chesapeake, VA (US)

(73) Assignees: AB CDM Vastra Frolunda, Gothenburg (SE); Ciba Specialty Chemicals Watertreatments Ltd., Bradeford (GB)

( * ) Notice: Subject to any disclaimer, the term of this patent is extended or adjusted under 35 U.S.C. 154(b) by 0 days.

(21) Appl. No.: 09/704,352

(22) Filed: Nov. 2, 2000

Related U.S. Application Data

(60) Provisional application No. 60/164,229, filed on Nov. 8, 1999.

(51) Int. Cl.[7] ..... D21H 17/42; D21H 17/65

(52) U.S. Cl. ..... 162/168.1; 162/168.3; 162/181.8

(58) Field of Search ..... 162/127, 128, 162/164.1, 164.6, 166, 168.1, 168.2, 168.3, 181.1, 181.6, 181.7, 181.8, 183, 175, 168.4

(56) References Cited

U.S. PATENT DOCUMENTS

| | | | | | |
|---|---|---|---|---|---|
| 4,388,150 | A | | 6/1983 | Sunden et al. | 162/175 |
| 4,840,705 | A | * | 6/1989 | Ikeda et al. | 162/175 |
| 5,015,334 | A | * | 5/1991 | Derrick | 162/168.1 |
| 5,032,227 | A | * | 7/1991 | Derrick et al. | 162/168.1 |
| 5,126,014 | A | * | 6/1992 | Chung | 162/164.6 |
| 5,171,891 | A | | 12/1992 | Masilamani et al. | 562/411 |
| 5,234,548 | A | * | 8/1993 | Hatton | 162/168.3 |
| 5,393,381 | A | | 2/1995 | Hund et al. | 162/168.3 |
| 5,482,693 | A | | 1/1996 | Rushmere et al. | 423/328.1 |
| 5,882,525 | A | | 3/1999 | Neff et al. | 210/735 |
| 5,902,455 | A | * | 5/1999 | Hund et al. | 162/164.1 |
| 5,958,188 | A | * | 9/1999 | Heard et al. | 162/168.2 |
| 6,020,422 | A | * | 2/2000 | Connors et al. | 524/716 |

FOREIGN PATENT DOCUMENTS

| | | | |
|---|---|---|---|
| EP | 0 102 760 | 3/1984 | |
| EP | 0 126 528 | 11/1984 | |
| EP | 0 150 933 | 8/1985 | |
| EP | 0 235 893 | 9/1987 | |
| EP | 0 308 752 | 3/1989 | |
| EP | 0 462 365 | 12/1991 | |
| EP | 0 484 617 | 5/1992 | |
| EP | 0 485 124 | 5/1992 | |
| EP | 0499448 | 8/1992 | D21H/17/16 |
| EP | 0608986 | 8/1994 | D21H/23/76 |
| WO | 86/00100 | 1/1986 | |
| WO | 97/33040 | 9/1997 | |
| WO | 97/33041 | 9/1997 | |
| WO | 98/29604 | 7/1998 | |
| WO | 98/30753 | 7/1998 | |
| WO | 99/16708 | 4/1999 | |

* cited by examiner

*Primary Examiner*—Peter Chin
*Assistant Examiner*—Eric Hug
(74) *Attorney, Agent, or Firm*—David R. Crichton

(57) ABSTRACT

A process of making paper or paper board comprising forming a cellulosic suspension, flocculating the suspension, draining the suspension on a screen to form a sheet and then drying the sheet, characterized in that the suspension is flocculated using a flocculation system comprising a clay and an anionic branched water soluble polymer that has been formed from water soluble ethylenically unsaturated anionic monomer or monomer blend and branching agent and wherein the polymer has (a) intrinsic viscosity above 1.5 dl/g and/or saline Brookfield viscosity of above about 2.0 mPa.s and (b) rheological oscillation value of tan delta at 0.005 Hz of above 0.7 and/or (c) deionised SLV viscosity number which is at least three times the salted SLV viscosity number of the corresponding unbranched polymer made in the absence of branching agent.

20 Claims, No Drawings

MANUFACTURE OF PAPER AND PAPERBOARD

This application claims benefit of No. 60/164229 filed Nov. 8, 1999.

This invention relates to processes of making paper and paperboard from a cellulosic stock, employing a novel flocculating system.

During the manufacture of paper and paper board a cellulosic thin stock is drained on a moving screen (often referred to as a machine wire) to form a sheet which is then dried. It is well known to apply water soluble polymers to the cellulosic suspension in order to effect flocculation of the cellulosic solids and enhance drainage on the moving screen.

In order to increase output of paper many modern paper making machines operate at higher speeds. As a consequence of increased machine speeds a great deal of emphasis has been placed on drainage and retention systems that provide increased drainage. However, it is known that increasing the molecular weight of a polymeric retention aid which is added immediately prior to drainage will tend to increase the rate of drainage but damage formation. It is difficult to obtain the optimum balance of retention, drainage, drying and formation by adding a single polymeric retention aid and it is therefore common practice to add two separate materials in sequence.

EP-A-235893 provides a process wherein a water soluble substantially linear cationic polymer is applied to the paper making stock prior to a shear stage and then reflocculating by introducing bentonite after that shear stage. This process provides enhanced drainage and also good formation and retention. This process which is commercialised by Ciba Specialty Chemicals under the Hydrocol® trade mark has proved successful for more than a decade.

More recently there have been various attempts to provide variations on this theme by making minor modifications to one or more of the components.

U.S. Pat. No. 5,393,381 describes a process in which a process of making paper or board by adding a water soluble branched cationic polyacrylamide and a bentonite to the fibrous suspension of pulp. The branched cationic polyacrylamide is prepared by polymerising a mixture of acrylamide, cationic monomer, branching agent and chain transfer agent by solution polymerisation.

U.S. Pat. No. 5,882,525 describes a process in which a cationic branched water soluble polymer with a solubility quotient greater than about 30% is applied to a dispersion of suspended solids, e.g. a paper making stock, in order to release water. The cationic branched water soluble polymer is prepared from similar ingredients to U.S. Pat. No. 5,393,381 i.e. by polymerising a mixture of acrylamide, cationic monomer, branching agent and chain transfer agent.

In WO-A-9829604 a process of making paper is described in which a cationic polymeric retention aid is added to a cellulosic suspension to form flocs, mechanically degrading the flocs and then reflocculating the suspension by adding a solution of a second anionic polymeric retention aid. The anionic polymeric retention aid is a branched polymer which is characterised by having a rheological oscillation value of tan delta at 0.005 Hz of above 0.7 or by having a deionised SLV viscosity number which is at least three times the salted SLV viscosity number of the corresponding polymer made in the absence of branching agent. The process provided significant improvements in retention and formation by comparison to the earlier prior art processes.

EP-A-308752 describes a method of making paper in which a low molecular weight cationic organic polymer is added to the furnish and then a colloidal silica and a high molecular weight charged acrylamide copolymer of molecular weight at least 500,000. The description of the high molecular weight polymers indicates that they are linear polymers.

However, there still exists a need to further enhance paper making processes by further improving drainage, retention and formation. Furthermore there also exists the need for providing a more effective flocculation system for making highly filled paper.

According to the present invention a process is provided for making paper or paper board comprising forming a cellulosic suspension, flocculating the suspension, draining the suspension on a screen to form a sheet and then drying the sheet, characterised in that the suspension is flocculated using a flocculation system comprising a swellable clay and an anionic branched water soluble polymer that has been formed from water soluble ethylenically unsaturated anionic monomer or monomer blend and branching agent and wherein the polymer has (a) intrinsic viscosity above 1.5 dl/g and/or saline Brookfield viscosity of above about 2.0 mPa.s and (b) rheological oscillation value of tan delta at 0.005 Hz of above 0.7 and/or (c) deionised SLV viscosity number which is at least three times the salted SLV viscosity number of the corresponding unbranched polymer made in the absence of branching agent.

It has surprisingly been found that flocculating the cellulosic suspension using a flocculation system that comprises a swellable clay and anionic branched water soluble polymer with the special rheological characteristics provides improvements in retention, drainage and formation by comparison to using the anionic branched polymer in the absence of the swellable clay system or the swellable clay in the absence of the anionic branched polymer.

The swellable clays may for instance be typically a bentonite type clay. The preferred clays are swellable in water and include clays which are naturally water swellable or clays which can be modified, for instance by ion exchange to render them water swellable. Suitable water swellable clays include but are not limited to clays often referred to as hectorite, smectites, montmorillonites, nontronites, saponite, sauconite, hormites, attapulgites and sepiolites. Typical anionic swelling clays are described in EP-A-235893 and EP-A-335575.

Most preferably the clay is a bentonite type clay. The bentonite may be provided as an alkali metal bentonite. Bentonites occur naturally either as alkaline bentonites, such as sodium bentonite or as the alkaline earth metal salt, usually the calcium or magnesium salt. Generally the alkaline earth metal bentonites are activated by treatment with sodium carbonate or sodium bicarbonate. Activated swellable bentonite clay is often supplied to the paper mill as dry powder. Alternatively the bentonite may be provided as a high solids flowable slurry, for example at least 15 or 20% solids, for instance as described in EP-A-485124, WO-A-9733040 and WO-A-9733041.

In paper making the bentonite may be applied to the cellulosic suspension as an aqueous bentonite slurry. Typically the bentonite slurry comprises up to 10% by weight bentonite. The bentonite slurry will normally comprise at least 3% bentonite clay, typically around 5% by weight bentonite. When supplied to the paper mill as a high solids flowable slurry usually the slurry is diluted to an appropriate concentration. In some instances the high solids flowable slurry of bentonite may be applied directly to the paper making stock.

The anionic branched polymer is formed from a water soluble monomer blend comprising at least one anionic or potentially anionic ethylenically unsaturated monomer and a small amount of branching agent for instance as described in WO-A-9829604. Generally the polymer will be formed from a blend of 5 to 100% by weight anionic water soluble monomer and 0 to 95% by weight non-ionic water soluble monomer. Typically the water soluble monomers have a solubility in water of at least 5 g/100 cc. The anionic monomer is preferably selected from the group consisting of acrylic acid, methacrylic acid, maleic acid, crotonic acid, itaconic acid, 2-acrylamido-2-methylpropane sulphonic acid, allyl sulphonic acid and vinyl sulphonic acid and alkali metal or ammonium salts thereof. The non-ionic monomer is preferably selected from the group consisting of acrylamide, methacrylamide, N-vinyl pyrrolidone and hydroxyethyl acrylate. A particularly preferred monomer blend comprises acrylamide and sodium acrylate.

The branching agent can be any chemical material that causes branching by reaction through the carboxylic or other pendant groups (for instance an epoxide, silane, polyvalent metal or formaldehyde). Preferably the branching agent is a polyethylenically unsaturated monomer which is included in the monomer blend from which the polymer is formed. The amounts of branching agent required will vary according to the specific branching agent. Thus when using polyethylenically unsaturated acrylic branching agents such as methylene bis acrylamide the molar amount is usually below 30 molar ppm and preferably below 20 ppm. Generally it is below 10 ppm and most preferably below 5 ppm. The optimum amount of branching agent is preferably from around 0.5 to 3 or 3.5 molar ppm or even 3.8 ppm but in some instances it may be desired to use 7 or 10 ppm. Preferably the branching agent is water-soluble. Typically it can be a difunctional material such as methylene bis acrylamide or it can be a trifunctional, tetrafunctional or a higher functional cross-linking agent, for instance tetra allyl ammonium chloride. Generally since allylic monomer tend to have lower reactivity ratios, they polymerise less readily and thus it is standard practice when using polyethylenically unsaturated allylic branching agents, such as tetra allyl ammonium chloride to use higher levels, for instance 5 to 30 or even 35 molar ppm or even 38 ppm and even as much as 70 or 100 ppm.

It may also be-desirable to include a chain transfer agent into the monomer mix. Where chain transfer agent is included it may be used in an amount of at least 2 ppm by weight and may also be included in an amount of up to 200 ppm by weight. Typically the amounts of chain transfer agent may be in the range 10 to 50 ppm by weight. The chain transfer agent may be any suitable chemical substance, for instance sodium hypophosphite, 2-mercaptoethanol, malic acid or thioglycolic acid. Preferably, however, the anionic branched polymer is prepared in the absence of added chain transfer agent.

The anionic branched polymer is generally in the form of a water-in-oil emulsion or dispersion. Typically the polymers are made by reverse phase emulsion polymerisation in order to form a reverse phase emulsion. This product usually has a particle size at least 95% by weight below 10 $\mu$m and preferably at least 90% by weight below 2 $\mu$m, for instance substantially above 100 nm and especially substantially in the range 500 nm to 1 $\mu$m. The polymers may be prepared by conventional reverse phase emulsion or microemulsion polymerisation techniques.

The tan delta at 0.005 Hz value is obtained using a Controlled Stress Rheometer in Oscillation mode on a 1.5% by weight aqueous solution of polymer in deionised water after tumbling for two hours. In the course of this work a Carrimed CSR 100 is used fitted with a 6 cm acrylic cone, with a 1°58' cone angle and a 58 $\mu$m truncation value (Item ref 5664). A sample volume of approximately 2–3 cc is used. Temperature is controlled at 20.0° C.±0.1° C. using the Peltier Plate. An angular displacement of $5\times10^{-4}$ radians is employed over a frequency sweep from 0.005 Hz to 1 Hz in 12 stages on a logarithmic basis. G' and G" measurements are recorded and used to calculate tan delta (G"/G') values. The value of tan delta is the ratio of the loss (viscous) modulus G" to storage (elastic) modulus G' within the system.

At low frequencies (0.005 Hz) it is believed that the rate of deformation of the sample is sufficiently slow to enable linear or branched entangled chains to disentangle. Network or cross-linked systems have permanent entanglement of the chains and show low values of tan delta across a wide range of frequencies, Therefore low frequency (e.g. 0.005 Hz) measurements are used to characterise the polymer properties in the aqueous environment.

The anionic branched polymers should have a tan delta value at 0.005 Hz of above 0.7. Preferred anionic branched polymers have a tan delta value of 0.8 at 0.005 Hz. Preferably the intrinsic viscosity is at least 2 dl/g, for instance at least 4 dl/g, in particular at least 5 or 6 dl/g. It may be desirable to provide polymers of substantially higher molecular weight, which exhibit intrinsic viscosities as high as 16 or 18 dl/g. However most preferred polymers have intrinsic viscosities in the range 7 to 12 dl/g, especially 8 to 10 dl/g.

The preferred branched anionic polymer can also be characterised by reference to the corresponding polymer made under the same polymerisation conditions but in the absence of branching agent (i.e., the "unbranched polymer"). The unbranched polymer generally has an intrinsic viscosity of at least 6 dl/g and preferably at least 8 dl/g. Often it is 16 to 30 dl/g. The amount of branching agent is usually such that the intrinsic viscosity is reduced by 10 to 70%, or sometimes up to 90%, of the original value (expressed in dl/g) for the unbranched polymer referred to above. The saline Brookfield viscosity of the polymer is measured by preparing a 0.1% by weight aqueous solution of active polymer in 1M NaCl aqueous solution at 25° C. using a Brookfield viscometer fitted with a UL adaptor at 6 rpm. Thus, powdered polymer or a reverse phase polymer would be first dissolved in deionised water to form a concentrated solution and this concentrated solution is diluted with the 1M NaCl aqueous. The saline solution viscosity is generally above 2.0 mPa.s and is usually at least 2.2 and preferably at least 2.5 mPa.s. Generally it is not more than 5 mPa.s and values of 3 to 4 are usually preferred. These are all measured at 60 rpm.

The SLV viscosity numbers used to characterise the anionic branched polymer are determined by use of a glass suspended level viscometer at 25° C., the viscometer being chosen to be appropriate according to the viscosity of the solution. The viscosity number is $\eta-\eta_o/\eta_o$ where $\eta$ and $\eta_o$ are the viscosity results for aqueous polymer solutions and solvent blank respectively. This can also be referred to as specific viscosity. The deionised SLV viscosity number is the number obtained for a 0.05% aqueous solution of the polymer prepared in deionised water. The salted SLV viscosity number is the number obtained for a 0.05% polymer aqueous solution prepared in 1M sodium chloride.

The deionised SLV viscosity number is preferably at least 3 and generally at least 4, for instance up to 7, 8 or higher. Best results are obtained when it is above 5. Preferably it is higher than the deionised SLV viscosity number for the unbranched polymer, that is to say the polymer made under the same polymerisation conditions but in the absence of the branching agent (and therefore having higher intrinsic viscosity). If the deionised SLV viscosity number is not higher than the deionised SLV viscosity number of the unbranched polymer, preferably it is at least 50% and usually at least 75% of the deionised SLV viscosity number of the unbranched polymer. The salted SLV viscosity number is usually below 1. The deionised SLV viscosity number is often at least five times, and preferably at least eight times, the salted SLV viscosity number.

According to the invention the components of the flocculation system may be combined into a mixture and introduced into the cellulosic suspension as a single composition. Alternatively the anionic branched polymer and the swellable clay may be introduced separately but simultaneously. Preferably, however, the swellable clay and the anionic branched polymer are introduced sequentially more preferably when the swellable clay is introduced into the suspension and then the anionic branched polymer.

In a preferred form of the invention the water soluble anionic branched polymer and swellable clay are added to the cellulosic suspension, which suspension has been pretreated with a cationic material. The cationic pre-treatment may be by incorporating cationic materials into the suspension at any point prior to the addition of the anionic branched polymer and swellable clay. Thus the cationic treatment may be immediately before adding the anionic branched polymer and swellable clay although preferably the cationic material is introduced into the suspension sufficiently early in order for it to be distributed throughout the cellulosic suspension before either the anionic branched polymer or swellable clay are added. It may be desirable to add the cationic material before one of the mixing, screening or cleaning stages and in some instances before the stock suspension is diluted. It may even be beneficial to add the cationic material into the mixing chest or blend chest or even into one or more of the components of the cellulosic suspension, for instance, coated broke or filler suspensions for instance precipitated calcium carbonate slurries.

The cationic material may be any number of cationic species such as water soluble cationic organic polymers, or inorganic materials such as alum, polyaluminium chloride, aluminium chloride trihydrate and aluminochloro hydrate. The water soluble cationic organic polymers may be natural polymers, such as cationic starch or synthetic cationic polymers. Particularly preferred are cationic materials that coagulate or flocculate the cellulosic fibres and other components of the cellulosic suspension.

According to another preferred aspect of the invention the flocculation system comprises at least three flocculent components. Thus this preferred system employs a water soluble branched anionic polymer, swellable clay and at least one additional flocculant/coagulant.

The additional flocculant/coagulant component is preferably added prior to either the swellable clay or anionic branched polymer. Typically the additional flocculant is a natural or synthetic polymer or other material capable of causing flocculation/coagulation of the fibres and other components of the cellulosic suspension. The additional flocculant/coagulant may be a cationic, non-ionic, anionic or amphoteric natural or synthetic polymer. It may be a natural polymer such as natural starch, cationic starch, anionic starch or amphoteric starch. Alternatively it may be any water soluble synthetic polymer which preferably exhibits ionic character. The preferred ionic water soluble polymers have cationic or potentially cationic functionality. For instance the cationic polymer may comprise free amine groups which become cationic once introduced into a cellulosic suspension with a sufficiently low pH so as to protonate free amine groups. Preferably however, the cationic polymers carry a permanent cationic charge, such as quaternary ammonium groups.

The additional flocculant/coagulant may be used in addition to the cationic pre-treatment step described above. In a particularly preferred system the cationic pretreatment is also the additional flocculant/coagulant. Thus this preferred process comprises adding a cationic flocculant/coagulant to the cellulosic suspension or to one or more of the suspension components thereof, in order to cationically pre-treat the cellulosic suspension. The suspension is subsequently subjected to further flocculation stages comprising addition of the water soluble anionic branched polymer and the swellable clay.

The cationic flocculant/coagulant is desirably a water soluble polymer which may for instance be a relatively low molecular weight polymer of relatively high cationicity. For instance the polymer may be a homopolymer of any suitable ethylenically unsaturated cationic monomer polymerised to provide a polymer with an intrinsic viscosity of up to 3 dl/g. Homopolymers of diallyl dimethyl ammonium chloride are preferred. The low molecular weight high cationicity polymer may be an addition polymer formed by condensation of amines with other suitable di- or tri-functional species. For instance the polymer may be formed by reacting one or more amines selected from dimethyl amine, trimethyl amine and ethylene diamine etc and epihalohydrin, epichlorohydrin being preferred.

Preferably the cationic flocculant/coagulant is a polymer that has been formed from a water soluble ethylenically unsaturated cationic monomer or blend of monomers wherein at least one of the monomers in the blend is cationic or potentially cationic. By water soluble we mean that the monomer has a solubility in water of at least 5 g/100 cc. The cationic monomer is preferably selected from di allyl di alkyl ammonium chlorides, acid addition salts or quaternary ammonium salts of either dialkyl amino alkyl (meth)acrylate or dialkyl amino alkyl (meth)acrylamides. The cationic monomer may be polymerised alone or copolymerised with water soluble non-ionic, cationic or anionic monomers. More preferably such polymers have an intrinsic viscosity of at least 3 dl/g, for instance as high as 16 or 18 dl/g, but usually in the range 7 or 8 to 14 or 15 dl/g.

Particularly preferred cationic polymers include copolymers of methyl chloride quaternary ammonium salts of dimethylaminoethyl acrylate or methacrylate. The water soluble cationic polymer may be a polymer with a rheological oscillation value of tan delta at 0.005 Hz of above 1.1 (defined by the method given herein) for instance as provided for in copending patent application based on the priority U.S. patent application No. 60/164,231 (reference PP/W-21916/P1/AC 526) filed with equal date to the priority of the present application.

The water soluble cationic polymer may also have a slightly branched structure for instance by incorporating small amounts of branching agent e.g. up to 20 ppm by weight. Typically the branching agent includes any of the branching agents defined herein suitable for preparing the branched anionic polymer. Such branched polymers may also be prepared by including a chain transfer agent into the monomer mix. The chain transfer may be included in an amount of at least 2 ppm by weight and may be included in an amount of up to 200 ppm by weight. Typically the amounts of chain transfer agent are in the range 10 to 50 ppm by weight. The chain transfer agent may be any suitable chemical substance, for instance sodium hypophosphite, 2-mercaptoethanol, malic acid or thioglycolic acid.

Branched polymers comprising chain transfer agent may be prepared using higher levels of branching agent, for instance up to 100 or 200 ppm by weight, provided that the amounts of chain transfer agent used are sufficient to ensure that the polymer produced is water soluble. Typically the branched cationic water soluble polymer may be formed from a water soluble monomer blend comprising at least one cationic monomer, at least 10 molar ppm of a chain transfer agent and below 20 molar ppm of a branching agent. Preferably the branched water soluble cationic polymer has a rheological oscillation value of tan delta at 0.005 Hz of above 0.7 (defined by the method given herein). Typically the branched cationic polymers have an instrinsic viscosity of at least 3 dl/g, Typically the polymers may have an intrinsic viscosity in the range 4 or 5 up to 18 or 19 dl/g. Preferred polymers have an intrinsic viscosity of from 7 or 8 to about 12 or 13 dl/g.

The cationic water soluble polymers may also be prepared by any convenient process, for instance by solution polymerisation, water-in-oil suspension polymerisation or by water-in-oil emulsion polymerisation. Solution polymerisation results in aqueous polymer gels which can be cut dried and ground to provide a powdered product. The polymers may be produced as beads by suspension polymerisation or as a water-in-oil emulsion or dispersion by water-in-oil emulsion polymerisation, for example according to a process defined by EP-A-150933, EP-A-102760 or EP-A-126528.

When the flocculation system comprises cationic polymer it is generally added in an amount sufficient to effect flocculation. Usually the dose of cationic polymer would be above 20 ppm by weight of cationic polymer based on dry weight of suspension. Preferably the cationic polymer is added in an amount of at least 50 ppm by weight for instance 100 to 2000 ppm by weight. Typically the polymer dose may be 150 ppm to 600 ppm by weight, especially between 200 and 400 ppm. Typically the amount of anionic branched polymer may be at least 20 ppm by weight based on weight of dry suspension, although preferably is at least 50 ppm by weight, particularly between 100 and 1000 ppm by weight. Doses of between 150 and 600 ppm by weight are more preferred, especially between 200 and 400 ppm by weight. The swellable clay may be added at a dose of at least 100 ppm by weight based on dry weight of suspension. For instance the dose of clay is in the range of 100 ppm to 15,000 ppm by weight. For some applications doses of 100 to 500 ppm even up to 1000 ppm may prove to be particularly suitable for the process of the invention. For some applications higher doses of clay may be preferred, for instance 1000 to 5000 ppm by weight.

In one preferred form of the invention the cellulosic suspension is subjected to mechanical shear following addition of at least one of the components of the flocculating system. Thus in this preferred form at least one component of the flocculating system is mixed into the cellulosic suspension causing flocculation and the flocculated suspension is then mechanically sheared. This shearing step may be achieved by passing the flocculated suspension through one or more shear stages, selected from pumping, cleaning or mixing stages. For instance such shearing stages include fan pumps and centri-screens, but could be any other stage in the process where shearing of the suspension occurs.

The mechanical shearing step desirably acts upon the flocculated suspension in such a way as to degrade the flocs. All of the components of the flocculating system may be added prior to a shear stage although preferably at least the last component of the flocculating system is added to the cellulosic suspension at a point in the process where there is no substantial shearing before draining to form the sheet. Thus it is preferred that at least one component of the flocculating system is added to the cellulosic suspension and the flocculated suspension is then subjected to mechanical shear wherein the flocs are mechanically degraded and then at least one component of the flocculating system is added to reflocculate the suspension prior to draining.

According to a more preferred form of the invention the water-soluble cationic polymer is added to the cellulosic suspension and then the suspension is then mechanically sheared. The swellable clay and the water-soluble branched anionic polymer are then added to the suspension. The anionic branched polymer and swellable clay may be added either as a premixed composition or separately but simultaneously but preferably they are added sequentially. Thus the suspension may be re-flocculated by addition of the branched anionic polymer followed by the swellable clay but preferably the suspension is reflocculated by adding the swellable clay and then the anionic branched polymer.

The first component of the flocculating system may be added to the cellulosic suspension and then the flocculated suspension may be passed through one or more shear stages. The second component of the flocculation system may be added to re-flocculate the suspension, which re-flocculated suspension may then be subjected to further mechanical shearing. The sheared reflocculated suspension may also be further flocculated by addition of a third component of the flocculation system. In the case where the addition of the components of the flocculation system is separated by shear stages it is preferred that the branched anionic polymer is the last component to be added.

In another form of the invention the suspension may not be subjected to any substantial shearing after addition of any of the components of the flocculation system to the cellulosic suspension. The swellable clay material, anionic branched polymer and where included the water soluble cationic polymer may all be introduced into the cellulosic suspension after the last shear stage prior to draining. In this form of the invention the water-soluble branched polymer may be the first component followed by either the cationic polymer (if included) and then the swellable clay. However, other orders of addition may also be used.

In one preferred form of the invention we provide a process of preparing paper from a cellulosic stock suspension comprising filler. The filler may be any traditionally used filler materials. For instance the filler may be clay such as kaolin, or the filler may be a calcium carbonate which could be ground calcium carbonate or in particular precipitated calcium carbonate, or it may be preferred to use titanium dioxide as the filler material.

Examples of other filler materials also include synthetic polymeric fillers. Generally a cellulosic stock comprising substantial quantities of filler are more difficult to flocculate. This is particularly true of fillers of very fine particle size, such as precipitated calcium carbonate. Thus according to a preferred aspect of the present invention we provide a process for making filled paper. The paper making stock may comprise any suitable amount of filler. Generally the cellulosic suspension comprises at least 5% by weight filler material. Typically the amount of filler is up to 40%, preferably between 10% and 40% filler. Desirably the final sheet of paper or paper board comprises up to 40% filler by weight. Thus according to this preferred aspect of this invention we provide a process for making filled paper or paper board wherein we first provide a cellulosic suspension comprising filler and in which the suspension solids are flocculated by introducing into the suspension a flocculating system comprising an swellable clay and water-soluble anionic branched polymer as defined herein.

In an alternative form of the invention form we provide a process of preparing paper or paperboard from a cellulosic stock suspension which is substantially free of filler.

The following examples illustrate the invention.

EXAMPLE 1 (Comparative)

The drainage properties are determined using Schopper-Riegler apparatus, with the rear exit blocked so the drainage water exits through the front opening. The cellulosic stock used is a 50/50 bleached birch/bleached pine suspension containing 40% by weight (on total solids) precipitated calcium carbonate. The stock suspension is beaten to a freeness of 55° (Schopper Riegler method) before the addition of filler. 5 kg per tonne (on total solids) cationic starch (0.045 DS) is added to the suspension.

A copolymer of acrylamide with methyl chloride quaternary ammonium salt of dimethylaminoethyl acrylate (75/25 wt./wt.) of intrinsic viscosity above 11.0 dl/g (Product A) is mixed with the stock and then after shearing the stock using a mechanical stirrer a branched water soluble anionic copolymer of acrylamide with sodium acrylate (65/35) (wt./wt.) with 6 ppm by weight methylene bis acrylamide of intrinsic viscosity 9.5 dl/g and rheological oscillation value of tan delta at 0.005 Hz of 0.9 (Product B) is mixed into the stock. The drainage time in seconds for 600 ml of filtrate to drain is measured at different doses of Product A and Product B. The drainage times in seconds are shown in Table 1.

TABLE 1

| | | Product B (g/t) | | | | |
|---|---|---|---|---|---|---|
| | | 0 | 250 | 500 | 750 | 1000 |
| Product A (g/t) | 0 | 108 | 31 | 18 | 15 | 15 |
| | 250 | 98 | 27 | 12 | 9 | 11 |
| | 500 | 96 | 26 | 10 | 12 | 9 |
| | 750 | 103 | 18 | 9 | 8 | 8 |
| | 1000 | 109 | 18 | 9 | 8 | 8 |
| | 2000 | 125 | 20 | 9 | 7 | 6 |

EXAMPLE 2

The drainage tests of Example 1 is repeated for a dose of 500 g/t product A and 250 g/t product B except that a bentonite is applied after the shearing but immediately prior to the addition of Product B. The drainage times are shown in Table 2.

TABLE 2

| Bentonite dosage (g/t) | drainage time (s) |
|---|---|
| 0 | 26 |
| 125 | 19 |
| 250 | 12 |
| 500 | 9 |

TABLE 2-continued

| Bentonite dosage (g/t) | drainage time (s) |
|---|---|
| 750 | 8 |
| 1000 | 7 |

As can be seen even a dose of 125 g/t bentonite substantially improves drainage.

EXAMPLE 3

Standard sheets of paper are produced using the cellulosic stock suspension of Example 1 and by first mixing the cationic copolymer Product A into the stock at a given dose and then shearing for 60 seconds and then mixing in product B at a given dose. The flocculated stock is then poured onto a fine mesh to form a sheet which is then dried at 80° C. for 2 hours. The formation of the paper sheets is determined using the Scanner Measurement System developed by PIRA International. The standard deviation (SD) of grey values is calculated for each image. The formation values for each dose of product A and product B is shown in Table 3. Lower values indicate better results.

TABLE 3

| | | Product B (g/t) | | | | |
|---|---|---|---|---|---|---|
| | | 0 | 250 | 500 | 750 | 1000 |
| Product A (g/t) | 0 | 6.84 | 8.78 | 11.54 | 14.34 | 17.96 |
| | 250 | 7.87 | 10.48 | 14.45 | 16.53 | 19.91 |
| | 500 | 8.80 | 10.88 | 16.69 | 20.30 | 23.04 |
| | 750 | 9.23 | 11.61 | 16.70 | 22.22 | 19.94 |
| | 1000 | 9.49 | 13.61 | 19.29 | 21.94 | 24.74 |
| | 2000 | 9.54 | 16.51 | 22.01 | 28.00 | 29.85 |

EXAMPLE 4

Example 3 is repeated except using doses of 500 g/t product A and a dose of 250 g/t product B and 125, 250, 500, 750 and 1000 g/t of bentonite applied after the shearing but immediately prior to the addition of Product B. The respective formation values for each dose of bentonite are shown in Table 4.

TABLE 4

| Bentonite dosage (g/t) | Formation |
|---|---|
| 0 | 10.88 |
| 125 | 11.26 |
| 250 | 14.47 |
| 500 | 16.44 |
| 750 | 17.17 |
| 1000 | 17.61 |

A comparison of doses required to provide equivalent drainage results demonstrates that the flocculating system utilising cationic polymer, bentonite and branched anionic water soluble polymer provides improved formation. For instance from Example 2 a dose of 500 g/t polymer A, 250 g/t polymer B and 1000 g/t bentonite provides a drainage time of 7 seconds. From Table 4 it can be seen the equivalent doses of product A, bentonite and product B gives a formation value of 17.61. From Example 1 a dose of 2000 g/t product A and 750 g/t product B in the absence of bentonite provides a drainage time of 7 seconds. From Table 3 the equivalent doses of product A and product B provides a formation value of 28.00. Thus for equivalent high drainage the invention improves formation by more than 37%. Even for equivalent higher drainage values, for instance 10 seconds, the improvements in formation can still be observed.

Thus it can be seen from the examples that using a flocculating system involving cationic polymer, bentonite and branched anionic water soluble polymer provides faster drainage and better formation than cationic polymer and branched anionic water soluble polymer in the absence of bentonite.

EXAMPLE 5 (Comparative)

The retention properties are determined by the standard Dynamic Britt Jar methods on the stock suspension of example 1 when using a flocculating system comprising cationic polymer (Product A) and a branched anionic polymer (Product B) in the absence of bentonite. The flocculating system is applied in the same way as for Example 3. The total retention figures are shown as percentages in Table 5

TABLE 5

| | | Product B (g/t) | | | | |
|---|---|---|---|---|---|---|
| | | 0 | 250 | 500 | 750 | 1000 |
| Product A (g/t) | 0 | 63.50 | 84.17 | 90.48 | 94.44 | 96.35 |
| | 125 | 33.58 | 73.44 | 87.66 | 92.27 | 94.59 |
| | 250 | 34.72 | 81.20 | 92.12 | 97.15 | 98.10 |
| | 500 | 37.43 | 84.77 | 94.86 | 97.65 | 98.58 |
| | 1000 | 36.01 | 84.68 | 94.91 | 97.16 | 99.19 |
| | 2000 | 45.24 | 96.92 | 99.16 | 99.63 | 99.76 |

EXAMPLE 6

Example 5 is repeated except using as the flocculation system 250 g/t cationic polymer (Product A), 250 g/t branched anionic polymer (Product B) and 125 to 1000 g/t bentonite. The flocculating system is applied in the same way as for Example 4. The total retention figures are shown in Table 6.

TABLE 6

| Dosage bentonite (g/t) | Retention (%) |
|---|---|
| 0 | 81.20 |
| 125 | 85.46 |
| 250 | 86.78 |
| 500 | 89.65 |
| 750 | 90.71 |
| 1000 | 91.92 |

From the results shown in Table 5, a dose of 250 g/t cationic polymer (Product A), 250 g/t branched anionic polymer (Product B) gives retention at 81.20. By introducing 1000 g/t of bentonite the retention is increased to 91.92. In order to achieve equivalent retention in the absence of bentonite a dose of 250 g/t Product A and 500 g/t Product B is required.

EXAMPLE 7

Drainage and turbidity is determined using a cellulosic suspension comprising a 80/20 hardwood/softwood pulp, 30% broke, precipitated calcium carbonate (40% based on dry weight of stock). The cellulosic suspension is diluted with clear filtrate to a fibre concentration of 0.9%.

Test 1 (Comparative)

6 kg/t of a cationic starch is mixed thoroughly with a 1000 ml sample of the stock suspension. After 30 seconds 400 g/t of a copolymer of acrylamide and methyl chloride quaternary ammonium salt of dimethylaminoethyl acrylate (60/40) of intrinsic viscosity above 10 dl/g is mixed into the stock and after a further 30 seconds 2 kg/t bentonite is mixed into the suspension. Stirring of the stock suspension is maintained at 1500 rpm throughout the addition of the treatment chemicals. The treated stock suspension is inverted in a beaker 6 times and then transferred to a SR tester with the rear backwater exit sealed and drainage time for 750 ml to drain and turbidity of the filtrate is measured.

Tests 2

Test 1 is repeated except only 1 kg/t of bentonite is applied and 225 g/t of a water soluble branched anionic copolymer of acrylamide with sodium acrylate (65/35) (wt./wt.) with 6 ppm by weight methylene bis acrylamide of intrinsic viscosity 9.5 dl/g and rheological oscillation value of tan delta at 0.005 Hz of 0.9 is added to the stock suspension after the bentonite.

Test 3

Test 2 is repeated except the cationic polymer is replaced by 450 g/t a copolymer of acrylamide with methyl chloride quaternary ammonium salt of dimethylamino ethyl acrylate (79/21 wt./wt.) of intrinsic viscosity above 8.5 dl/g and rheological oscillation value of tan delta at 0.005 Hz of 1.82.

Test 4

Test 3 is repeated except the order of addition of the bentonite and branched anionic polymer is reversed.

The drainage and turbidity measurements are shown in table 7.

TABLE 7

| Test | Drainage (s) | Turbidity FNU |
|---|---|---|
| 1 | 19 | 95 |
| 2 | 22 | 60 |
| 3 | 20 | 41 |
| 4 | 19 | 39 |

FNU stands for Formazine Nephelometric Units which are units of turbidity.

The results clearly show that the use of the branched anionic polymer improves turbidity of the filtrate. Reduced turbidity is a measure of improved filler and fines retention.

EXAMPLE 8

Drainage and turbidity is determined using a cellulosic suspension comprising 70 parts by weight of a 70/30 TMP/softwood pulp, 30 parts by weight of a 80/20 coated/uncoated broke. The cellulosic suspension is diluted with clear filtrate to a fibre concentration of 0.8%.

Test 1 (Comparative)

2 kg/t of a cationic starch (DS 0.042) is mixed thoroughly with a 1000 ml sample of the stock suspension. After 30 seconds 700 g/t of a copolymer of acrylamide and methyl chloride quaternary ammonium salt of dimethylaminoethyl acrylate (60/40) of intrinsic viscosity above 10 dl/g is mixed into the stock and after thoroughly mixing 2 kg/t bentonite is mixed into the suspension. Stirring of the stock suspension is maintained at 1500 rpm throughout the addition of the treatment chemicals. The treated stock suspension is inverted in a beaker 6 times and then transferred to a SR tester with the rear backwater exit sealed and drainage time for 250 ml to drain and turbidity of the filtrate is measured.

Test 2

Test 1 is repeated except 125, 250 and 450 g/t of a water soluble branched anionic copolymer of acrylamide with sodium acrylate (65/35) (wt./wt.) with 6 ppm by weight methylene bis acrylamide of intrinsic viscosity 9.5 dl/g and rheological oscillation value of tan delta at 0.005 Hz of 0.9 is added after the bentonite.

The drainage and turbidity results are shown in Table 9

TABLE 9

| Branched Anionic dose (g/t) | Drainage time (s) | Turbidity (FNU) |
|---|---|---|
| 0 | 47 | 132 |
| 125 | 31 | 90 |
| 250 | 24 | 70 |
| 450 | 18 | 60 |

The results show that the addition of anionic branched polymer improves both the drainage time and also turbidity.

Test 3

Test 2 is repeated except that a constant dose of 250 g/t of the branched polymer and 0.5, 1.0, 1.5 and 2.0 kg/t of bentonite is used.

The drainage and turbidity results for the tests are shown in Table 10.

TABLE 10

| Bentonite dose (kg/t) | Drainage time (s) | Turbidity (FNU) |
|---|---|---|
| 0.5 | 47 | 105 |
| 1.0 | 36 | 92 |
| 1.5 | 29 | 86 |
| 2.0 | 25 | 70 |

The results show that the use of the anionic branched polymer improves drainage and turbidity even when a reduced level of bentonite is used. The test using 0.5 kg/t bentonite and 250 g/t branched anionic polymer gives similar drainage results and still better turbidity to the equivalent process using 2 kg/t bentonite and no branched anionic polymer.

What is claimed is:

1. A process of making paper or paper board comprising forming a cellulosic suspension, flocculating the suspension, draining the suspension on a screen to from a sheet and then drying the sheet, characterised in that the suspension is flocculated using a flocculation system comprising a water soluble cationic polymer, a swellable clay and an anionic branched water soluble polymer that has been formed from water soluble ethylenically unsaturated anionic monomer or monomer blend and branching agent and wherein the cationic polymer has (a) intrinsic viscosity of at least 4 dl/g and (b) rheological oscillation value of tan delta at 0.005 Hz of above 0.7 calculated on a 1.5% by weight aqueous solution of polymer and/or (c) deionised SLV viscosity number which is at least three times the salted SLV viscosity number of the corresponding unbranched cationic polymer made in the absence of branching agent, wherein the water-soluble cationic polymer is added to the cellulosic suspension and then the suspension is mechanically sheared after which the swellable clay and the anionic branched water soluble polymer are added.

2. A process according to claim 1 in which the swellable clay is a bentonite type clay.

3. A process according to claim 1 in which the swellable clay is selected from the group consisting of hectorite, smectites, montmorillonites, nontronites, saponite, sauconite, hormites, attapulgites and sepiolites.

4. A process according to claim 1 in which the anionic branched polymer has an intrinsic viscosity above 4 dl/g and tan delta at 0.005 Hz of above 0.7 calculated on a 1.5% by weight aqueous solution of polymer.

5. A process according to claim 1 in which the components of the flocculation system are introduced into the cellulosic suspension sequentially.

6. A process according to claim 1 in which the swellable clay is introduced into the suspension and then the anionic branched polymer is included in the suspension.

7. A process according to claim 1 in which the anionic branched polymer is introduced into the suspension and then the swellable clay is included in the suspension.

8. A process according to claim 1 in which the anionic branched water soluble polymer and swellable clay components of the flocculation system are introduced into the cellulosic suspension simultaneously.

9. A process according to claim 1 in which the cellulosic suspension is pre-treated by inclusion of a cationic material into the suspension or component thereof prior to introducing the anionic branched polymer and swellable clay.

10. A process according to claim 9 in which the cationic material is selected from water soluble cationic organic polymers, or inorganic materials such as alum, polyaluminium chloride, aluminium chloride trihydrate and aluminochloro hydrate.

11. A process according to claim 1 in which the cationic polymer is formed from a water soluble ethylenically unsaturated monomer or water soluble blend of ethylenically unsaturated monomers comprising at least one cationic monomer.

12. A process according to claim 1 in which the cationic polymer is a branched cationic polymer which has an intrinsic viscosity above 3 dl/g and exhibits a rheological oscillation value of tan delta at 0.005 Hz of above 0.7 calculated on a 1.5% by weight aqueous solution of polymer.

13. A process according to claim 1 in which the cationic polymer has an intrinsic viscosity above 3 dl/g and exhibits a rheological oscillation value of tan delta at 0.005 Hz of above 1.1 calculated on a 1.5% by weight aqueous solution of polymer.

14. A process according to claim 1 in which the suspension is subjected to mechanical shear following the addition of at least one of the components of the flocculating system.

15. A process according to claim 1 in which the cellulosic suspension is reflocculated by introducing the swellable clay and then the anionic branched water soluble polymer.

16. A process according to claim 1 in which the cellulosic suspension is reflocculated by introducing the anionic branched polymer and then the swellable clay.

17. A process according to claim 1 in which the cellulosic suspension comprises filler.

18. A process according to claim 17 in which the sheet of paper or paper board comprises filler in an amount up to 40% by weight.

19. A process according to claim 17 in which the filler material is selected from precipitated calcium carbonate, ground calcium carbonate, clay (especially kaolin) and titanium dioxide.

20. A process according to claim 1 in which the cellulosic suspension is substantially free of filler.

* * * * *

UNITED STATES PATENT AND TRADEMARK OFFICE

CERTIFICATE OF CORRECTION

PATENT NO. : 6,391,156 B1
APPLICATION NO. : 09/704352
DATED : May 21, 2002
INVENTOR(S) : Bo Hjalmarson et al.

It is certified that error appears in the above-identified patent and that said Letters Patent is hereby corrected as shown below:

Column 13

Lines 53 and 54 should read:

-- monomer blend and branching agent and wherein the anionic polymer has --.

Signed and Sealed this

Fourteenth Day of November, 2006

JON W. DUDAS
*Director of the United States Patent and Trademark Office*